US005200000A

United States Patent [19]

Yamamoto et al.

[11] Patent Number: 5,200,000

[45] Date of Patent: Apr. 6, 1993

[54] PHOSPHATE TREATMENT SOLUTION FOR COMPOSITE STRUCTURES AND METHOD FOR TREATMENT

[75] Inventors: Katsuya Yamamoto, Yokohama; Kenichi Fukuya, Fujisawa; Tsuneo Saito, Yokohama, all of Japan

[73] Assignees: Nihon Parkerizing Co., Ltd.; Nissan Motor Co., both of Japan

[21] Appl. No.: 472,029

[22] Filed: Jan. 30, 1990

[30] Foreign Application Priority Data

Jan. 31, 1989 [JP] Japan ..... 1-21975

[51] Int. Cl.[5] ..... C23C 22/36

[52] U.S. Cl. ..... 148/262

[58] Field of Search ..... 148/262

[56] References Cited

U.S. PATENT DOCUMENTS

| | | | |
|---|---|---|---|
| 2,500,673 | 3/1950 | Gibson | 148/262 |
| 3,619,300 | 11/1968 | Heller | 148/262 |
| 4,961,769 | 5/1985 | Miyamoto et al. | 148/262 |

FOREIGN PATENT DOCUMENTS

| | | | |
|---|---|---|---|
| 0019430 | 11/1980 | European Pat. Off. . | |
| 2818426 | 12/1978 | Fed. Rep. of Germany | 148/262 |
| 0144477 | 8/1983 | Japan | 148/262 |
| 0204889 | 10/1985 | Japan | 148/262 |
| 1-191785 | 8/1989 | Japan | 148/262 |
| 1324460 | 11/1971 | United Kingdom | 148/262 |
| 2072225 | 9/1981 | United Kingdom | 148/262 |

*Primary Examiner*—Sam Silverberg

*Attorney, Agent, or Firm*—Ostrolenk, Faber, Gerb & Soffen

[57] ABSTRACT

A phosphate treatment solution for composite structures which is here disclosed is characterized by containing 0.3–2.0 g/l of zinc ions, 0.3–4.0 g/l of nickel ions, 0.3–2.0 g/l of manganese ions, 3–10 g/l of sodium ions, 0.1–10 g/l of potassium ions, 5.0–25.0 g/l of phosphate ions, 0.1–20 g/l of total fluorine ions, 4.0 g/l or more of nitrate ions and 0.01–1.0 g/l of nitrite ions as main components, the aforesaid treatment solution having a pH of 2.0–3.5.

12 Claims, No Drawings

PHOSPHATE TREATMENT SOLUTION FOR COMPOSITE STRUCTURES AND METHOD FOR TREATMENT

BACKGROUND OF THE INVENTION (i) Field of the Invention

The present invention relates to a phosphate treatment solution for treating the surfaces of automobile bodies constituted by the combination of steel plates and other materials such as zinc and aluminum, i.e., the composite structures, and it also relates to a method for the treatment.

(ii) Description of the Prior Art

Heretofore, when an automobile body containing aluminum materials as constitutional parts is treated with a phosphate solution, the aluminum parts are first subjected to a chromate treatment mainly to heighten performance, and the thus treated aluminum parts are then assembled to the automobile body comprising steel plates and zinc-plated steel plates. Afterward, the phosphate treatment is carried out again, followed by a cathodic electrodeposition coating. According to this known technique, chromium and aluminum are partly dissolved out from the first formed chromate coating on the aluminum parts in the subsequent phosphate treatment step, so that the chromate coating tends to become in an imperfect state, and thus it is natural that the phosphate coating is not formed, either.

In the above-mentioned technique, the aluminum parts are subjected to the chromate treatment prior to assembling these aluminum parts to the automobile as described above, and therefore chromium and aluminum are dissolved out in the subsequent phosphate treatment step, so that the chromate coating and the phosphate coating becomes in an imperfect state. In consequence, when a paint coating is subsequently carried out, the resulting paint film is poor in adhesive performance, and in particular, there is a problem that the secondary adhesion after water-soaking (hereinafter, wet adhesion) is poor.

In the manufacturing process of the automobile bodies, parts assembly, pretreatment and paint coating are carried out in this order, and in the conventional process, the aluminum parts are separately treated by another procedure. That is, the aluminum parts are subjected to a water-rinsing, a chromate treatment and a water-rinsing/drying in this order, and further subjected to the above-mentioned assembly, the pretreatment and the paint coating. Therefore, there is also the problem that operating efficiency is bad and cost is high.

In the case that the aluminum parts are assembled to the automobile body without performing any chromate treatment and then subjected to the phosphate treatment, the conventional known treatment solution cannot provide any phosphate coating having satisfactory performance, i.e., excellent filiform corrosion resistance and wet adhesion, on the surfaces of the aluminum parts. A poor coating is merely formed which is unsuitable for the automobile bodies where the high paint film performance is required. In addition, aluminum ions are dissolved into the phosphate treatment solution in this treatment step, and inconveniently, these aluminum ions have a bad influence on the phosphate coating on the surfaces of other kinds of materials in the automobile body.

SUMMARY OF THE INVENTION

The present invention has been achieved to solve the above-mentioned conventional various problems.

An object of the present invention is to provide an improved phosphate treatment solution for composite structures.

Another object of the present invention is to provide an efficient method for the treatment of composite structures.

The first feature of the present invention is directed to a phosphate treatment solution for composite structures which is characterized by containing 0.3–2.0 g/l of zinc ions, 0.3–4.0 g/l of nickel ions, 0.3–2.0 g/l of manganese ions, 3–10 g/l of sodium ions, 0.1–10 g/l of potassium ions, 5.0–25.0 g/l of phosphate ions, 0.1–20 g/l of total fluorine ions, 4.0 g/l or more of nitrate ions and 0.01–1.0 g/l of nitrite ions as main components, the aforesaid treatment solution having a pH of 2.0–3.5, the aforesaid total fluorine ions being composed of complex fluorine ions of in 0.1–5 g/l as fluorine and free fluoride ions in an amount of 0.01–2 g/l.

The second feature of the present invention is directed to a method for treating composite structures which is characterized by using the above-mentioned treatment solution and a mixture of sodium bifluoride and potassium bifluoride as an additive liquid, while the concentration of the free fluoride ions is maintained.

The present invention can be applied to a conventional manufacturing procedure without changing it, and even in this case, an excellent phosphate coating can be formed on the surfaces of the composite structures as a basecoat for cathodic electrodeposition coating.

When the content of the aluminum ions in the treatment solution increases up to a level of 400 ppm or more with use, the concentration of the free fluoride ions should be maintained at 0.01–2 g/l, whereby that of the total fluorine ions are controlled to be in the range of 1–20 g/l.

DETAILED DESCRIPTION OF THE INVENTION

For composite structures comprising different materials such as aluminum, steel and galvanized steel (including zinc alloy plated, galvanized etc.), a phosphate treatment is simultaneously possible, if the following requirements are met:

(1) The resulting paint films on all the different materials being excellent in the performace.

(2) The concentration of aluminum ions being controlled sufficiently. If not controlled, aluminum is dissolved into phosphate treatment solution during the treatment, so that aluminum ions are accumulated and thereby impede the formation of the phosphate coating and deteriorate the performance of the coating.

Therefore, it is essential for the present invention that the total fluorine ions present in the treatment solution are composed of 0.1–5 g/l of complex fluorine ions and 0.01–2 g/l of free fluoride ions [=(total fluorine ions)—(fluorine content in complex fluorine ions)—(fluorine content in $AlF_3$)]. When the composite structures are immersed in the treatment solution at 30°–55° C. for 1–5 minutes in accordance with the present invention in order to form a zinc phosphate coating on the surfaces of the structures, it is characterized that the coating contains 1–10% (preferably about 4%) of each of nickel and manganese.

The aluminum ions, which are dissolved into the treatment solution and then gradually accumulated therein, prevent the formation of the phosphate coating on steel plates and aluminum surfaces of the composite structures. In particular, when the content of the aluminum ions (which substantially corresponds to that of the free fluoride ions) is 150 ppm or more, the formation of the phosphate coating is extremely poor. Accordingly, in the continuous treatment by the use of the treatment solution, $KHF_2$ and $NaHF_2$ are suitably added in an amount corresponding to the amount of the dissolved aluminum ions in accordance with the formula $$Al^{+3}+2KHF_2+NaHF_2 \rightarrow K_2NaAlF_6 \downarrow +3H^+$$

in order to maintain the concentration of the free fluoride ions in a predetermined range and to control the concentration of the dissolved aluminum ions, whereby the proper phosphate coating can be formed on the surfaces of the composite structures. It should be noted here that the same effect can be obtained by means of adding NaF, KF and HF as can be seen from the following reaction formula:

$$Al^{3+}+2KF+NaF+3HF\ K_2NaAlF_6 \downarrow +3H^+$$

In this case, the concentration of the aluminum ions is controlled by adjusting the concentration of the free fluoride ions in the treatment solution, and this control is accomplished by adding $KHF_2$ and $NaHF_2$ thereto in order to precipitate the aluminum ions in the form of $K_2NaAlF_6$. It is important that these fluorides are not used separately but as a mixture of the sodium bifluoride and the potassium bifluoride in a ratio of one molecule of the former:two molecules of the latter, and this mixture can be added to the treatment solution continuously or intermittently. Such a procedure permits instantaneously forming the precipitate of the aluminum compound, accurately measuring the concentration of the free fluoride ions, and easily controlling the concentration of the aluminum ions. In this case, the mixture of the above-mentioned fluorides may be liquid or solid.

When the phosphate treatment solution of the present invention is used, the following characteristics can be perceived: On an iron material and a zinc-plated material of the composite structures, there is formed a phosphate coating which is substantially comparable to what is formed by an usual phosphate treatment, and on an aluminum material, there is formed a coating having a noticeably high performace. That is, on the aluminum surface, the phosphate coating of $Zn_3(PO_4)_2.4H_2O$ can usually three components of phosphoric acid, hydrofluoric acid and zinc are used. However, in the present invention, nickel and manganese are additionally present in each ratio of 1 to 10% in the phosphate coating as described above, and therefore the coating crystals are densified and the wet adhesion and the outdoor exposure performace are improved. Now, the phosphate coating formed by using the treatment solution of the present invention were compared with conventional phosphate coating after a finish-painting. The results are set forth in Table 1.

TABLE 1

(comparison of coating after finish painting)

| | Coating Weight | Ni in the Coating | Mn in the Coating | Blister Width after Exposed for 1 year | Wet Adhesion* |
|---|---|---|---|---|---|
| Zn-Phosphate Type of Conventional Example | 1.0 g/m$^2$ | 0% | 0% | 15 mm | 28/100 |
| Chromate Type of Conventional Example | — | — | — | 3 mm | 95/100 |
| Present Invention | 1.0 g/m$^2$ | 15% | 36% | 1 mm | 100/100 |

*Please refer to the Table 2.

Composition of conventional zinc phosphate system treatment solution

Zn: 1.2 g/l
Na: 7.0 g/l
$PO_4$: 15 g/l
$NO_3$: 7 g/l
$SiF_6$: 3 g/l
$NO_2$: 0.5 g/l
pH: 3.2

Composition of conventional chromate treatment solution $CrO_4$: 7 g/l
$PO_4$: 10 g/l
F: 2 g/l
pH: 1.5

Composition of treatment solution of the present invention $Zn^{2+}$: 1.4 g/l
$Ni^{2+}$: 1.5 g/l
$Mn^{2+}$: 0.5 g/l
$PO_4^{-3}$: 15.5 g/l
$SiF_6^{-2}$: 3 g/l
$F^-$: 100 ppm
$NO_3^-$: 7 g/l
$K^+$: 0.5 g/l
$Na^+$: 7 g/l
$NO_2^-$: 0.2 g/l
pH: 3.2

Now, a treatment solution and a treatment method of the present invention will be described in detail in reference to an example, and the effect of the present invention will also be elucidated by comparing with conventional examples.

EXAMPLE 1

(1) Composition of treatment solution $Zn^{2+}$: 1.1–1.2 g/l
$Ni^{2+}$: 0.9–1.0 g/l
$Mn^{2+}$: 0.4–0.6 g/l
$PO_4^{3-}$: 15.0–15.5 g/l
$SiF_6^{2-}$: 2–3 g/l
free $F^-$: 0.08–0.15 g/l
$NO_3^-$: 6–8 g/l $K^+$: 0.05–0.5 g/l
$Na^+$: 6.8–7.8 g/l
$NO_2^-$: 0.15–0.25 g/l
pH: 3.2–3.3

(2) Treatment conditions

Immersion at 45° C. for 2 minutes

Under the above-mentioned conditions, an automobile body comprising an aluminum plate of #5000 type, an electrogalvanized steel plate, a zinc-nickel-plated steel plate and a steel plate (Fe:Al:Zn—Ni=6:1:3) was immersed in the above-mentined treatment solution in a ratio of 2 $m^2$/l, while the concentration of free fluoride was measured and adjusted so as to be in the controlled range [free fluorine=(amount of total fluorine)—(fluorine content in complex fluorine)—(F in $AlF_3$)], while a 5% mixed aqueous solution of a $KHF_2$ powder having a water content of 10% and $NaHF_2$ flakes in a ratio of two molecules:one molecule was added thereto, and while a replenishing solution was also added thereto so as to maintain concentrations of other components. Afterward, the performance of each specimen was measured. The results are set forth in Table 2.

COMPARATIVE EXAMPLE 1

The same procedure as in Example 1 was repeated with the exception that the mixed solution of $KHF_2$ and $NaHF_2$ was replaced with a 5% $NaHF_2$. The results are set forth in Table 2.

COMPARATIVE EXAMPLE 2

The same procedure as in Example 1 was repeated with the exception that the concentration of free fluoride was maintained at about 0 g/l. The results are set forth in Table 2.

In this case, piping systems are more liable to clog than in Example 1.

COMPARATIVE EXAMPLE 3

The same procedure as in Example 1 was repeated with the exception that the mixed solution of $KHF_2$ and $NaHF_2$ was replaced with a 5% $KHF_2$ solution. The results are set forth in Table 2.

COMPARATIVE EXAMPLE 4

The same procedure as in Example 1 was conducted except that $Mn^{2+}$ was eliminated from the treatment solution.

COMPARATIVE EXAMPLE 5

The same procedure as in Example 1 was conducted except that $Ni^{2+}$ was eliminated from the treatment solution.

TABLE 2

| Test Item | Plate for Test | Example 1 | Comparative Example 1 | 2 | 3 | 4 | 5 |
|---|---|---|---|---|---|---|---|
| Wet Adhesion* | Aluminum Plate | 100/100 | 81/100 | 28/100 | 76/100 | 95/100 | 90/100 |
| | Zinc-plated Steel Plate | 100/100 | 100/100 | 36/100 | 100/100 | 98/100 | 90/100 |
| | Steel Plate | 100/100 | 100/100 | 62/100 | 100/100 | 100/100 | 100/100 |
| Outdoor Exposure Performance* | Aluminum Plate | 1 mm | 4 mm | 15 mm | 3 mm | 2 mm | 4 mm |
| | Zinc-plated Steel Plate | 3 mm | 4 mm | 16 mm | 4 mm | 4 mm | 8 mm |
| | Steel Plate | 10 mm | 12 mm | 20 mm | 13 mm | 10 mm | 15 mm |
| $Al^{3+}$ in Treatment Solution | | 5 ppm | 120 ppm | 150 ppm | 110 ppm | 5 ppm | 7 ppm |
| Coating Weight | Aluminum Plate | 1.2 g/$m^2$ | 0.1 g/$m^2$ | 0 | 0.2 g/$m^2$ | 1.1 g/$m^2$ | 1.3 g/$m^2$ |
| Ni in the Coating | Aluminum Plate | 17 mg/$m^2$ | 2 mg/$m^2$ | 0 | 4 mg/$m^2$ | 19 mg/$m^2$ | 0 |
| Mn in the Coating | Aluminum Plate | 36 mg/$m^2$ | 3 mg/$m^2$ | 0 | 5 mg/$m^2$ | 0 | 5 mg/$m^2$ |

*Painting Conditions:
Cathodic Electrodeposition → Baking at 175° C. for 20 min. → Intercoating → Topcoating
Cathodic Electrodeposition: Power Top U-100 made by Nippon Paint Co., Ltd.; 20 μm
Intercoating: KPX36 made by Kansai Paint Co., Ltd.; 30–35 μm
Topcoating: Acrylic type. White, made by Kansai Paint Co., Ltd.; 30 μm
*Wet Adhesion Test:
Test panels with above-mentioned painting are immersed in deionized water at 40° C. for 500 hrs. After left standing for 24 hrs, they are scribed to one hundred 1 mm squares, over which tape-peeling test is done and remaining-sound squares are counted.

As described above, the phosphate treatment solution for composite structures of the present invention contains predetermined amounts of Ni ions and Mn ions, and in the method for the treatment of the present invention, the content of free fluoride ions is controlled in a predetermined range. In consequence, it is possible to continuously treat even the composite structures inclusive of aluminum parts, which means that workability is improved by the present invention. In addition, the phosphate coating formed on the surfaces of the composite structures exerts the effect of improving the performance of paint film obtained by a subsequent cathodic electrodeposition in the wet adhesion and outdoor exposure adhesion.

According to the method of the present invention, undesirable aluminum ions which are dissolved out in a continuous treatment step of the composite structures inclusive of the aluminum parts are successively precipitated and removed in the form of $K_2NaAlF_6$ by adding a mixture of $KHF_2$ and $NaHF_2$. Therefore, the present invention can provide the excellent phosphate coating.

What is claimed is:

1. A phosphate treatment solution for composite structures having a combination of steels, zinc-plated steels and aluminum materials consisting essentially of an aqueous solution containing 0.3–2.0 g/l of zinc ions, 0.3–4.0 g/l of nickel ions, 0.3–2.0 g/l of manganese ions, 3–10 g/l of sodium ions, 0.1–10 g/l of potassium ions, 5.0-25.0 g/l of phosphate ions, 0.1–20 g/l of total fluorine ions, 4.0 g/l or more of nitrate ions and 0.01–1.0 g/l of nitrite ions.

said treatment solution having a pH of 2.0–3.5, and said total fluorine ions being composed of 0.1–5 g/l as fluorine of complex fluorine ions and 0.01–2 g/l of free fluoride ions in which said free fluoride ions (g/l)=said total fluorine ions (g/l)—fluorine (g/l) in said complex fluorine ions—fluorine ions (g/l) in $FlF_3$.

2. A phosphate treatment solution for composite structures according to claim 1 wherein said treatment solution contains said free fluoride ions in excess of corresponding aluminum ions dissolved out in a treatment step.

3. A phosphate treatment solution for composite structures according to claim 1 which is applied to form an basecoat for cathodic electrodeposition coating.

4. A method for treating composite structures comprising a combination of steels, zinc-plated steels and aluminum materials which is characterized by contacting said structure with an acidic treatment solution consisting essentially of 0.3-2.0 g/l of zinc ions, 0.3-4.0 g/l of nickel ions, 0.3-2.0 g/l of manganese ions, 3-10 g/l of sodium ions, 0.1-10 g/l of potassium ions, 5.0-25.0 g/l of phosphate ions, 0.1-20 g/l of total fluorine ions, 4.0 g/l or more of nitrate ions and 0.01-1.0 g/l of nitrite ions as main components, said treatment solution having a pH of 2.0-3.5, said total fluorine ions being composed of 0.1-5 g/l as fluorine of complex fluorine ions and 0.01-2 g/l of free fluoride ions, said solution containing a mixture of sodium bifluoride and potassium bifluoride sufficient to maintain said concentration f said free fluoride ions.

5. A method for treating composite structures according to claim 4 wherein said mixture is composed of sodium bifluoride and potassium bifluoride in a ratio of one molecule of the former:two molecules of the latter.

6. A method for treating composite structures according to claim 5 wherein said treatment solution contains 1.1-1.4 g/l of zinc ions, 0.9-1.5 g/l of nickel ions, 0.4-0.6 g/l manganese ions, 6.8-7.8 g/l of sodium ions, 0.05 -5 g/l of potassium ions, 15-15.5 g/l of phosphate ions, 6-8 g/l of nitrate ions, 0.15-0.25 g/l of nitrite ions, 2-3 g/l of $SiF_6$ *l ions*, 0.01-0.15 g/l of free fluoride ions and a pH of 3.2-3.3.

7. A method for treating composite structures according to claim 6 wherein said treatment solution contains 1.4 g/l of zinc ions, 1.5 g/l of nickel ions, 0.5 g/l of manganese ions, 7 g/l of sodium ions, 0.5 g/l of potassium ions, 15.5 g/l of phosphate ions, 7 g/l of nitrate ions, 0.2 g/l of nitrite ions, 3 g/l of $SiF_6$ ions, 100 ppm of free fluoride ions and a pH of 3.2.

8. A method for treating composite structures according to claim 6 wherein said treatment solution contains 1.1-1.2 g/l of zinc ions, 0.9-1 g/l of nickel ions and 0.08-0.15 g/l of free fluoride ions.

9. A method for treating composite structures according to claim 4 in which said structure is immersed in said acidic treatment solution.

10. A phosphate treatment solution for composite structures according to claim 1 containing 1.1-1.4 g/l of zinc ions, 0.9-1.5 g/l of nickel ions, 0.4-0.6 g/l manganese ions, 6.8-7.8 g/l of sodium ions, 0.05-5 g/l of potassium ions, 15-15.5 g/l of phosphate ions, 6-8 g/l of nitrate ions, 0.15-0.25 of nitrite ions, 2-3 g/l of $SiF_6$ ions, 0.01-0.15 g/l of free fluoride ions and a pH of 3.2-3.3.

11. A phosphate treatment solution for composite structures according to claim 10 containing 1.4 g/l of zinc ions, 1.5 g/l of nickel ions, 0.5 g/l of manganese ions, 7 g/l of sodium ions, 0.5 g/l of potassium ions, 15.5 g/l of phosphate ions, 7 g/l of nitrate ions, 0.2 g/l of nitrite ions, 3 g/l of $SiF_6$ ions, 100 ppm of free fluoride ions and a pH of 3.2.

12. A phosphate treatment solution for composite structures according to claim 10 containing 1.1-1.2 g/l of zinc ions, 0.9-1 g/l of nickel ions and 0.08-0.15 g/l of free fluoride ions.

* * * * *